US008438704B2

(12) United States Patent
Wirtz et al.

(10) Patent No.: US 8,438,704 B2
(45) Date of Patent: May 14, 2013

(54) FIBER AIR-LAYING PROCESS FOR FIBROUS STRUCTURES SUITABLE FOR USE IN ABSORBENT ARTICLES

(75) Inventors: Birgit Wirtz, Köln (DE); Thomas Ludwig Woschnik, Euskirchen (DE); Silvio W. Miccio, Bonn (DE)

(73) Assignee: The Procter & Gamble Company, Cincinnati, OH (US)

( * ) Notice: Subject to any disclaimer, the term of this patent is extended or adjusted under 35 U.S.C. 154(b) by 287 days.

(21) Appl. No.: 12/884,837

(22) Filed: Sep. 17, 2010

(65) Prior Publication Data

US 2011/0061214 A1 Mar. 17, 2011

(30) Foreign Application Priority Data

Sep. 17, 2009 (EP) ..... 09011850

(51) Int. Cl.
*D04H 1/00* (2006.01)

(52) U.S. Cl.
USPC ..... 19/148; 19/296

(58) Field of Classification Search ..... 19/98, 99, 19/148, 296, 303, 304, 305, 308
See application file for complete search history.

(56) References Cited

U.S. PATENT DOCUMENTS

| | | | | |
|---|---|---|---|---|
| 2,751,633 | A * | 6/1956 | Clark | 425/83.1 |
| 3,087,203 | A * | 4/1963 | Pearson | 19/145.5 |
| 3,860,003 | A | 1/1975 | Buell | |
| 4,144,619 | A * | 3/1979 | White et al. | 19/304 |
| 4,640,810 | A * | 2/1987 | Laursen et al. | 264/518 |
| 4,650,409 | A * | 3/1987 | Nistri et al. | 425/82.1 |
| 4,732,552 | A * | 3/1988 | Chung | 425/82.1 |
| 5,037,416 | A | 8/1991 | Allen et al. | |
| 5,137,537 | A | 8/1992 | Herron et al. | |
| 5,151,092 | A | 9/1992 | Buell et al. | |
| 5,269,775 | A | 12/1993 | Freeland et al. | |
| 5,517,726 | A * | 5/1996 | Beier | 19/296 |
| 5,554,145 | A | 9/1996 | Roe et al. | |
| 5,569,234 | A | 10/1996 | Buell et al. | |
| 5,866,173 | A | 2/1999 | Reiter et al. | |
| 5,890,264 | A * | 4/1999 | Shofner et al. | 19/205 |
| 6,004,306 | A | 12/1999 | Robles et al. | |
| 6,726,461 | B2 * | 4/2004 | Hyvarinen et al. | 425/80.1 |
| 7,597,200 | B2 * | 10/2009 | Christensen | 209/295 |
| 2003/0070262 | A1 * | 4/2003 | Andersen | 19/296 |
| 2004/0255430 | A1 * | 12/2004 | Catry et al. | 19/296 |

FOREIGN PATENT DOCUMENTS

| | | |
|---|---|---|
| EP | 0 168 957 | 1/1986 |
| EP | 0 383 616 A1 | 8/1990 |
| WO | WO 86/00097 | 1/1986 |
| WO | WO 03/016605 A1 | 2/2003 |

OTHER PUBLICATIONS

PCT International Search Report, Mailed Nov. 17, 2010, 13 pages.

* cited by examiner

*Primary Examiner* — Shaun R Hurley
(74) *Attorney, Agent, or Firm* — Charles R. Matson; Richard L. Alexander

(57) ABSTRACT

The present invention refers to a process of making a fibrous structure, wherein roughly graded material is provided to rotating, apertured drums. The drums have at least one needle roll in their inside. The roughly graded material is agitated inside the drums, whereby fibers or small fiber clusters are separated from each other. These fibers and small fiber clusters are flung through the apertures to the outside of the drum, where they are directed onto a foraminous carrier to form a fibrous structure. The fibrous structures are especially useful in absorbent articles.

17 Claims, 4 Drawing Sheets

FIBER AIR-LAYING PROCESS FOR FIBROUS STRUCTURES SUITABLE FOR USE IN ABSORBENT ARTICLES

CROSS REFERENCE TO RELATED APPLICATION

This application claims the benefit of EP Application No. 09011850.6 filed Sep. 17, 2009, the substance of which is incorporated herein by reference.

FIELD OF THE INVENTION

The present invention relates to a fiber air-laying process to make fibrous structures which are suitable for use in absorbent articles.

BACKGROUND OF THE INVENTION

The use of fibrous structures in absorbent articles such as diapers or feminine hygienic articles is well known in the art. Fibrous structures may be either consolidated, bonded webs, such as nonwoven webs, but can also be unbonded structures, often made of natural fibers such as cellulose fibers or chemically modified cellulose fibers.

Unbonded fibrous structures can for example be used as absorbent cores, wherein the fibers are typically mixed with superabsorbent gelling materials, such as superabsorbent polymer particles. Moreover, such unbonded fibrous structures can be used in so-called liquid acquisition systems overlaying the absorbent core.

With the processes used today for high speed manufacture of fibrous webs for absorbent articles, it is difficult to make unbonded fibrous webs having a relatively low basis weight, such as basis weights below 120 g/m$^2$ as such fibrous webs typically suffer from poor homogeneity, resulting in holes in the web and low web integrity. When used in absorbent articles, holes lead to reduced integrity of the fibrous structure, which can reduce the liquid handling performance of absorbent articles.

Generally, numerous processes are known in the industry for laying down fibers in fibrous structures. One process has been developed by Scan Web. The process is described for example in European Patent Application EP 168 957 A1 and in WO 86/00097 A1. However, up to now this process did not appear to be suitable for manufacturing absorbent articles, if the air-laid fibrous structure is to be made in-line with the manufacture of absorbent article. One reason has been that the fibrous structures produced with the Scan Web process typically have a relatively large width. They cannot be used in absorbent articles without prior cutting and slitting the webs in the longitudinal direction, which is a challenge for unbonded fibrous structures. Simply reducing the width of the available equipment does not meet the throughput requirements with regard to mass flow-rate as required by today's absorbent article production lines.

SUMMARY OF THE INVENTION

The present invention refers to a process for making a fibrous structure, the process comprising the steps of:

a) providing a fibrous material in the form of roughly graded material:
b) providing a plurality of apertured, cylindrical drums; each of the drums having an inlet and being rotatably mounted about an longitudinal axis, and wherein the inside of each drum comprises one ore more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;
c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;
d) providing a low-pressure below the foraminous carrier;
e) supplying the roughly graded material into the apertured, cylindrical drums through the inlet of each drum, wherein the roughly graded material is transported in an air-stream;
f) rotating the roughly graded material inside the apertured, cylindrical drums, whereby the roughly graded material is agitated within the drums by the needle rolls, thereby separating the fibers, and transporting the fibers through the apertures of the drums; and
g) drawing the fibers onto the foraminous carrier whereby the fibers are deposited to form a fibrous structure on the foraminous carrier, the fibrous structure having a width of from 4 cm to 25 cm.

It should be understood that for the present invention, separating the fibers, as required in step f), does not mean that all fibers have to be present as individual fibers. The fibers may still be present in small clusters, as long as the clusters are small enough to be transported through the apertures of the apertured, cylindrical drums.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Definitions

Figure 1:
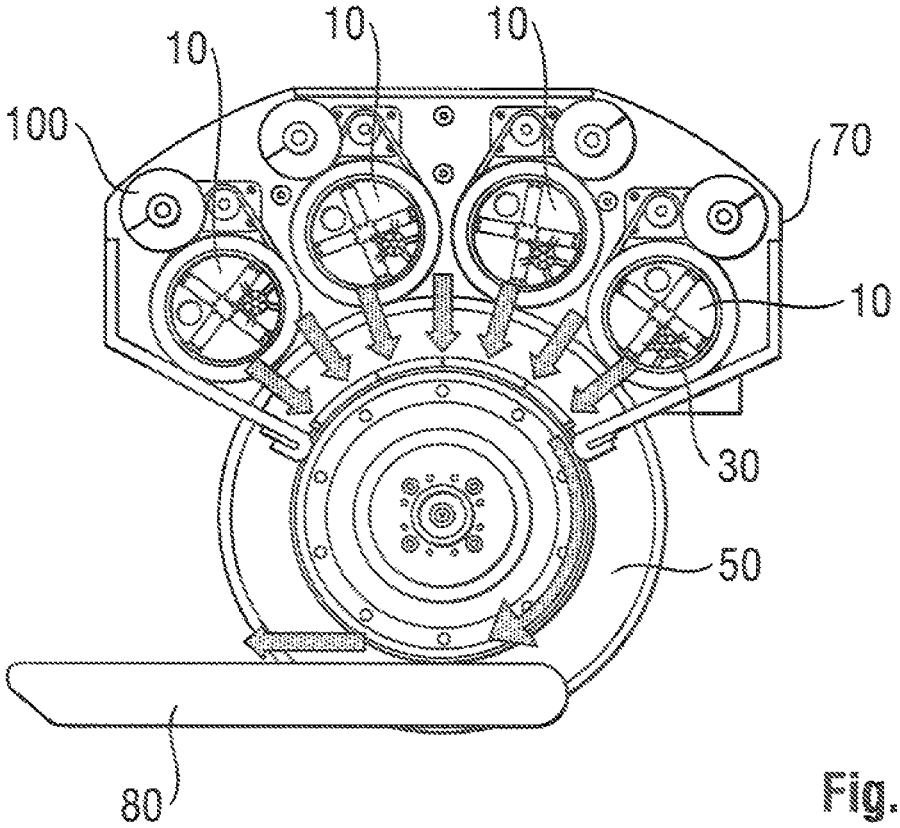
FIGS. 1 and 2 are a representation of one embodiment of an apparatus for carrying out the process of the present invention.

"Absorbent article" refers to devices that absorb and contain body exudates, and, more specifically, refers to devices that are placed against or in proximity to the body of the wearer to absorb and contain the various exudates discharged from the body. Absorbent articles may include diapers, pants, training pants, adult incontinence undergarments, feminine hygiene products, and the like. As used herein, the term "body fluids" or "body exudates" includes, but is not limited to, urine, blood, vaginal discharges, breast milk, sweat and fecal matter. Preferred absorbent articles of the present invention are diapers, pants, training pants and feminine hygiene products such as sanitary napkins and/or sanitary pads "Absorbent core" means a structure typically disposed between a topsheet and a backsheet of an absorbent article for absorbing and containing liquid received by the absorbent article. The absorbent core typically comprises absorbent material such as airfelt (comprising cellulose fibers), superabsorbent particles, or absorbent foams. In one embodiment, the absorbent core may be substantially cellulose free (i.e. less than 1% cellulose) and may comprise one or more substrates, absorbent polymer material disposed on the one or more substrates, and a thermoplastic composition on the absorbent particulate polymer material and at least a portion of the one or more substrates for immobilizing the absorbent particulate polymer material on the one or more substrates. In a multilayer absorbent core, the absorbent core may also include a cover layer. The one or more substrates and the cover layer may comprise a nonwoven. For the present invention, the absorbent core does not include an acquisition system, a topsheet, or a backsheet of the absorbent article.

"Absorbent polymer material," "absorbent gelling material," "AGM," "superabsorbent," and "superabsorbent material" are used herein interchangeably and refer to cross linked polymeric materials that can absorb at least 5 times their weight of an aqueous 0.9% saline solution as measured using the Centrifuge Retention Capacity test (Edana 441.2-01).

"Absorbent particulate polymer material" is used herein to refer to an absorbent polymer material which is in particulate form so as to be flowable in the dry state.

"Airfelt" is used herein to refer to comminuted wood pulp, which is a form of cellulose fibers.

"Comprise," "comprising," and "comprises" are open ended terms, each specifies the presence of what follows, e.g., a component, but does not preclude the presence of other features, e.g., elements, steps, components known in the art, or disclosed herein.

"Consisting essentially of" is used herein to limit the scope of subject matter, such as that in a claim, to the specified materials or steps and those that do not materially affect the basic and novel characteristics of the subject matter.

"Disposable" is used in its ordinary sense to mean an article that is disposed or discarded after a limited number of usage events over varying lengths of time, for example, less than about 20 events, less than about 10 events, less than about 5 events, or less than about 2 events. A disposable absorbent article is most often disposed after single use.

"Diaper" refers to an absorbent article generally worn by infants and incontinent persons about the lower torso so as to encircle the waist and legs of the wearer and that is specifically adapted to receive and contain urinary and fecal waste. As used herein, term "diaper" also includes "pants" which is defined below.

"Pant" or "training pant", as used herein, refer to disposable garments having a waist opening and leg openings designed for infant or adult wearers. A pant may be placed in position on the wearer by inserting the wearer's legs into the leg openings and sliding the pant into position about a wearer's lower torso. A pant may be preformed by any suitable technique including, but not limited to, joining together portions of the article using refastenable and/or non-refastenable bonds (e.g., seam, weld, adhesive, cohesive bond, fastener, etc.). A pant may be preformed anywhere along the circumference of the article (e.g., side fastened, front waist fastened). While the terms "pant" or "pants" are used herein, pants are also commonly referred to as "closed diapers," "prefastened diapers," "pull-on diapers," "training pants," and "diaper-pants".

A "nonwoven web" is a manufactured sheet, web or batt of directionally or randomly orientated fibers, bonded by friction, and/or cohesion and/or adhesion, excluding paper and products which are woven, knitted, tufted, stitch-bonded incorporating binding yarns or filaments, or felted by wet-milling, whether or not additionally needled. The fibers may be of natural or man-made origin and may be staple or continuous filaments or be formed in situ. Commercially available fibers have diameters ranging from less than about 0.001 mm to more than about 0.2 mm and they come in several different forms such as short fibers (known as staple, or chopped), continuous single fibers (filaments or monofilaments), untwisted bundles of continuous filaments (tow), and twisted bundles of continuous filaments (yarn). Nonwoven fabrics can be formed by many processes such as meltblowing, spunbonding, solvent spinning, electrospinning, carding and airlaying. The basis weight of nonwoven fabrics is usually expressed in grams per square meter (gsm).

"Roughly graded material" as used herein refers to fibrous material, wherein the majority of the fibers are not individualized. Thus, the majority of the fibers are present as clusters in the roughly graded material. A fiber cluster as used herein is an aggregation of several fibers (several hundreds up to several thousand fibers). The fiber clusters may have a diameter of only a few millimeters or have a diameter of up to several centimeters, e.g. up to 5 cm, depending how well the fiber clusters have been isolated and taken out from the raw material, which is typically provided in densely packed bales.

Absorbent Articles Comprising the Fibrous Structure

Figure 6:
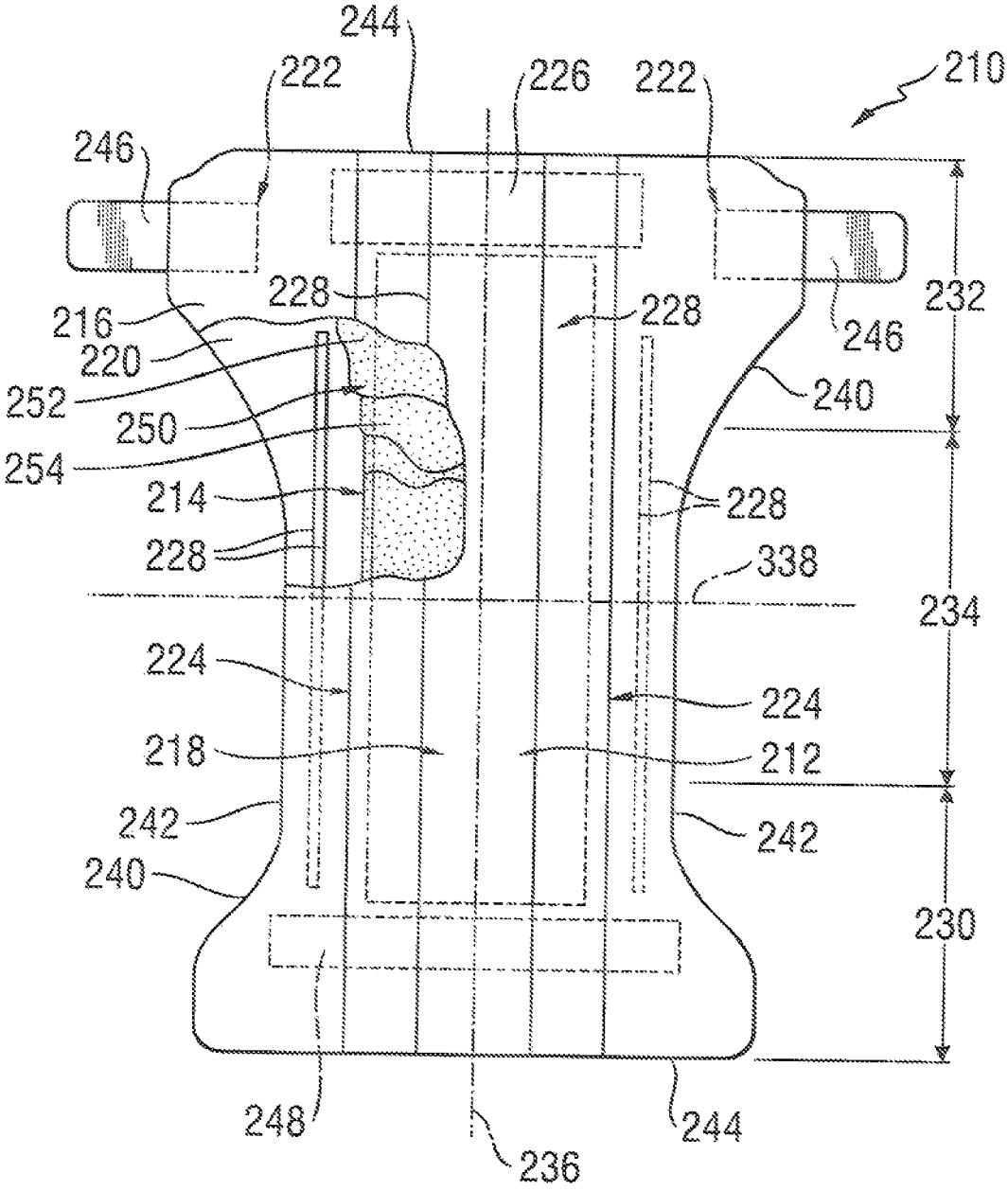
FIG. 6 is a plan view of a diaper comprising the fibrous structure made by the process of the present invention.

FIG. 6 is a plan view of a diaper 210 according to a certain embodiment of the present invention. The diaper 210 is shown in its flat out, uncontracted state (i.e. without elastic induced contraction) and portions of the diaper 210 are cut away to more clearly show the underlying structure of the diaper 210. A portion of the diaper 210 that contacts a wearer is facing the viewer in FIG. 6. The diaper 210 generally may comprise a chassis 212 and an absorbent core 214 disposed in the chassis.

The chassis 212 of the diaper 210 in FIG. 6 may comprise the main body of the diaper 210. The chassis 212 may comprise an outer covering 216 including a topsheet 218, which may be liquid pervious, and/or a backsheet 220, which may be liquid impervious. The absorbent core 214 may be encased between the topsheet 218 and the backsheet 220. The chassis 212 may also include side panels 222, elasticized leg cuffs 224, and an elastic waist feature 226.

The leg cuffs 224 and the elastic waist feature 226 may each typically comprise elastic members 228. One end portion of the diaper 210 may be configured as a first waist region 230 of the diaper 210. An opposite end portion of the diaper 210 may be configured as a second waist region 232 of the diaper 210. An intermediate portion of the diaper 210 may be configured as a crotch region 234, which extends longitudinally between the first and second waist regions 230 and 232. The waist regions 230 and 232 may include elastic elements such that they gather about the waist of the wearer to provide improved fit and containment (elastic waist feature 226). The crotch region 234 is that portion of the diaper 210 which, when the diaper 210 is worn, is generally positioned between the wearer's legs.

The diaper 210 is depicted in FIG. 6 with its longitudinal axis 236 and its transverse axis 338. The periphery 240 of the diaper 210 is defined by the outer edges of the diaper 210 in which the longitudinal edges 242 run generally parallel to the longitudinal axis 236 of the diaper 210 and the end edges 244 run between the longitudinal edges 242 generally parallel to the transverse axis 338 of the diaper 210. The chassis 212 may also comprise a fastening system, which may include at least one fastening member 246 and at least one stored landing zone 248.

The diaper 220 may also include such other features as are known in the art including front and rear ear panels, waist cap features, elastics and the like to provide better fit, containment and aesthetic characteristics. Such additional features are well known in the art and are e.g., described in U.S. Pat. No. 3,860,003 and U.S. Pat. No. 5,151,092.

In order to keep the diaper 210 in place about the wearer, at least a portion of the first waist region 230 may be attached by the fastening member 246 to at least a portion of the second waist region 232 to form leg opening(s) and an article waist. According to certain embodiments, the diaper 210 may be provided with a re-closable fastening system or may alternatively be provided in the form of a pant-type diaper. When the absorbent article is a diaper, it may comprise a re-closable fastening system joined to the chassis for securing the diaper to a wearer. When the absorbent article is a pant-type diaper, the article may comprise at least two side panels joined to the chassis along their longitudinal edges facing towards the longitudinal axis 236 and joined to each other along their longitudinal edges facing away from the longitudinal axis 236 to form a pant. The fastening system and any component thereof may include any material suitable for such a use, including but not limited to plastics, films, foams, nonwoven, woven, paper, laminates, fiber reinforced plastics and the like, or combinations thereof. In certain embodiments, the materials making up the fastening device may be flexible. The flexibility may allow the fastening system to conform to the shape of the body and thus, reduce the likelihood that the fastening system will irritate or injure the wearer's skin.

For unitary absorbent articles, the chassis 212 and absorbent core 214 may form the main structure of the diaper 210 with other features added to form the composite diaper structure. While the topsheet 218, the backsheet 220, and the absorbent core 214 may be assembled in a variety of well-known configurations, preferred diaper configurations are described generally in U.S. Pat. No. 5,554,145 entitled "Absorbent Article With Multiple Zone Structural Elastic-Like Film Web Extensible Waist Feature" issued to Roe et al. on Sep. 10, 1996; U.S. Pat. No. 5,569,234 entitled "Disposable Pull-On Pant" issued to Buell et al. on Oct. 29, 1996; and U.S. Pat. No. 6,004,306 entitled "Absorbent Article With Multi-Directional Extensible Side Panels" issued to Robles et al. on Dec. 21, 1999.

The topsheet 218 in FIG. 6 may be fully or partially elasticized or may be foreshortened to provide a void space between the topsheet 218 and the absorbent core 214. Exemplary structures including elasticized or foreshortened topsheets are described in more detail in U.S. Pat. No. 5,037,416 entitled "Disposable Absorbent Article Having Elastically Extensible Topsheet" issued to Allen et al. on Aug. 6, 1991; and U.S. Pat. No. 5,269,775 entitled "Trisection Topsheets for Disposable Absorbent Articles and Disposable Absorbent Articles Having Such Trisection Topsheets" issued to Freeland et al. on Dec. 14, 1993.

The backsheet 226 may be joined with the topsheet 218. The backsheet 220 may prevent the exudates absorbed by the absorbent core 214 and contained within the diaper 210 from soiling other external articles that may contact the diaper 210, such as bed sheets and undergarments. In certain embodiments, the backsheet 226 may be substantially impervious to liquids (e.g., urine) and comprise a laminate of a nonwoven and a thin plastic film such as a thermoplastic film having a thickness of 0.012 mm to 0.051 mm. Suitable backsheet films include those manufactured by Tredegar Industries Inc. of Terre Haute, Ind. and sold under the trade names X15306, X10962, and X10964. Other suitable backsheet materials may include breathable materials that permit vapors to escape from the diaper 210 while still preventing liquid exudates from passing through the backsheet 210. Taking a cross section of FIG. 6 along the sectional line 2-2 of FIG. 6 and starting from the wearer facing side, the diaper 210 may comprise the topsheet 218, the components of the absorbent core 214, and the backsheet 220. Diaper 210 also comprises an acquisition system 250 disposed between the liquid permeable topsheet 218 and the wearer facing side of the absorbent core 214. The acquisition system 250 may be in direct contact with the absorbent core.

The acquisition system 250 may comprise a single layer or multiple layers, such as an upper acquisition layer 252 facing towards the wearer and a lower acquisition 254 layer facing the garment of the wearer. According to a certain embodiment, the acquisition system 250 may function to receive a surge of liquid, such as a gush of urine. In other words, the acquisition system 250 may serve as a temporary reservoir for liquid until the absorbent core 214 can absorb the liquid.

In a certain embodiment, the acquisition system 250 may comprise chemically cross-linked cellulose fibers. Such cross-linked cellulose fibers may have desirable absorbency properties. Exemplary chemically cross-linked cellulose fibers are disclosed in U.S. Pat. No. 5,137,537. In certain embodiments, the chemically cross-linked cellulose fibers are cross-linked with between 0.5 mole % and 10.0 mole % of a $C_2$ to $C_9$ polycarboxylic cross-linking agent or between 1.5 mole % and about 6.0 mole % of a $C_2$ to $C_9$ polycarboxylic cross-linking agent based on glucose unit. Citric acid and polyacrylic acid are exemplary cross-linking agents. Further, according to certain embodiments, the cross-linked cellulose fibers have a water retention value of about 25 to 60, or 28 to 50, or 30 to 45. A method for determining water retention value is disclosed in U.S. Pat. No. 5,137,537. According to certain embodiments, the cross-linked cellulose fibers may be crimped, twisted, or curled, or a combination thereof.

The chemically cross-linked cellulose fibers may be provided as a fibrous structure made according to the process of the present invention.

In one embodiment, the lower acquisition layer 254 may consist of or may comprise a non-woven, which may be hydrophilic. Further, according to a certain embodiment, the lower acquisition layer 254 may comprise the chemically cross-linked cellulose fibers, which may or may not form part of a nonwoven material. In one embodiment of the present invention, the lower acquisition layer 254 comprises the fibrous structure made according to the process of the present invention. Further, according to an embodiment, the lower acquisition layer 254 may comprise the chemically cross-linked cellulose fibers mixed with other fibers such as natural or synthetic polymeric fibers. According to exemplary embodiments, such other natural or synthetic polymeric fibers may include high surface area fibers, thermoplastic binding fibers, polyethylene fibers, polypropylene fibers, PET fibers, rayon fibers, lyocell fibers, and mixtures thereof. According to a particular embodiment, the lower acquisition layer 254 has a total dry weight, the cross-linked cellulose fibers are present on a dry weight basis in the upper acquisition layer in an amount from 30% to 100% by weight of the lower acquisition layer 254, or from 50% to 95% and the other natural or synthetic polymeric fibers are present on a dry weight basis in the lower acquisition layer 254 in an amount up to 70%, or from 5% to 30% by weight of the lower acquisition layer 254. According to a certain embodiment, the lower acquisition layer 254 desirably has a high fluid uptake capability. Fluid uptake is measured in grams of absorbed fluid per gram of absorbent material and is expressed by the value of "maximum uptake." A high fluid uptake corresponds therefore to a high capacity of the material and is beneficial, because it ensures the complete acquisition of fluids to be absorbed by an acquisition material. Notably, the fibrous structures of the present invention may also be useful in other parts of an absorbent article such as the absorbent core or a component of the absorbent core.

In one embodiment, the acquisition layer only consists of a fibrous structure made by the process of the present invention. The fibrous layer may only consist of a single layer. Alternatively, the fibrous layer made comprise several layers, the layers having e.g. different kinds of fibers, as explained in more detail below.

The absorbent core 214 may comprise any absorbent material which is generally compressible, conformable, non-irritating to the wearer's skin, and capable of absorbing and retaining urine, such as comminuted wood pulp, creped cellulose wadding; melt blown polymers, including coform; chemically stiffened, modified or cross-linked cellulose fibers; tissue, including tissue wraps and tissue laminates; absorbent foams; absorbent sponges; absorbent polymer material or any other known absorbent material or combinations of materials. The absorbent material may be at least partially surrounded by a nonwoven fabric, often referred to as core wrap or core cover. The core wrap or core cover may consist of an upper layer towards the body-facing surface of the absorbent article and of a lower layer towards the garment-facing side of the absorbent article. The two layers may be continuously or intermittently bonded to each other around their perimeters. The upper and lower layer may be made of the same nonwoven fabric or may be made of different nonwoven fabric, i.e. the upper layer may be fluid pervious whereas the lower layer may be fluid impervious. The core wrap/core cover may also consist of a single nonwoven fabric, which envelops the absorbent material. It is preferred that the absorbent cores comprises more than 80% of absorbent polymer material by weight of absorbent material (i.e. excluding the core wrap, if present), more preferably more than 90%. The absorbent core may even be free of airfelt, i.e. 100% absorbent polymer material. The absorbent polymer material is preferably absorbent particulate polymer material.

The absorbent core may be provided as a fibrous structure made according to the process of the present invention. This may be especially suitable in absorbent articles wherein the absorbent core has a relatively low basis weight.

Process of Making the Fibrous Structure

The process of the present invention will now be explained in more detail with reference to FIGS. 1 to 5.

For the process of the present invention, fibers are transported in an air stream and introduced into a plurality of apertured, cylindrical drums 10. The apertured, cylindrical drums 10 are formed with apertures 20 of a predetermined shape, number, and size as specifically related to the types of fibers and/or particles utilized. One or more rotatable needle rolls 30 with a central shaft 35 and radially outwardly extending needles 40 are positioned inside of each of the apertured, cylindrical drums 20 to agitate the fibers, separate them (at least to a degree that very small fiber clusters are formed which can pass through the apertures of the apertured, cylindrical drums) and throw them outwardly through the apertures 20. Downwardly directed air flow facilitated by a pressure differential transports the refined fibers so as to form a homogeneous fibrous structure on the surface of the foraminous carrier 50 (e.g. by applying vacuum below the foraminous carrier 50).

The fibers typically enter the system at a feeding device (not shown). The feeding device may be a hammermill, or any other suitable device known in the art for "fiber opening" which operates to separate clumps of very densely packed fibers (e.g. untreated cellulose fibers, modified cellulose fibers or synthetic staple fibers) into masses of roughly graded material. The stream of roughly graded material is mixed with appropriate quantities of air to thereby produce an air-borne stream of roughly graded material. The air-borne roughly graded material is then directed to the plurality of apertured, cylindrical drums through feeding tubes 60 of a suitable number and dimension.

For the process of the present invention, the apertured, cylindrical drums 10 may have a diameter from 200 mm to 500 mm; or from 250 mm to 400 mm; or from 250 to 350 mm. The longitudinal dimension of the apertured, cylindrical drums 10 in the process of the present invention may be from 40 mm to 250 mm, or from 50 mm to 200 mm; or from 70 to 130 mm.

Each of the apertured, cylindrical drums 10 is provided with a plurality of apertures 20 which extend through the drum around its circumference. The apertures 20 are of a predetermined shape, number, and size as specifically related to the types of fibers introduced to the apertured, cylindrical drums. To accept flow of relatively short fibers, apertures are preferably circular. To accept flow of relatively long fibers, or of blends of long and short fibers, apertures are preferably of an elongate shape. Because the elongate apertures are typically larger than the circular apertures, their number will generally be moderate per unit length of the drum in comparison to the circular apertures. E.g. the diameter of the apertures may be equivalent to or up to 10 times higher than the length of the fibers introduced into the system.

The size of the apertures also depends on how big the fiber clusters are in the roughly graded material and how densely the fibers are aggregated with each other in these fibers clusters when entering the apertured, cylindrical drums.

Also, the bigger the size of the apertures is and the higher the number of apertures per drum is, the higher is the throughput of the drums, i.e. the more fibers will pass through the apertures per time. On the other side, the bigger the apertures are, the coarser/less homogeneous the fibrous structure will become.

Chemically modified cellulose fibers suitable for use in absorbent articles (e.g. as part of the acquisition system as set out supra) typically have a length of 2 to 5 mm. For such fibers circular apertures are preferred. The apertures should have a diameter from 5 mm to 15 mm.

Examples for longer fibers are synthetic staple fibers, which typically have an average fiber length of 20 mm to 45 mm; or of 20 mm to 40 mm; or of 25 mm to 40 mm. For those fibers the apertures should have an elongate shape, for example an elongate rectangular shape, wherein the length of the apertures is from 20 mm to 50 mm.

For the present invention it has been found that with relatively large apertures (having a length from 20 to 50 mm; or having a diameter of 5 to 15 mm for round apertures) fibrous structures can be obtained which are suitable for use in absorbent articles. Compared to other common uses (e.g. table cloth) relatively coarse fibrous structures are acceptable, as long as the resulting fibrous structure does not yield holes and has sufficient homogeneity to facilitate satisfactory liquid transport and liquid distribution within the absorbent article.

Relatively large apertures in the apertured, cylindrical drums have the benefit of allowing relatively large mass throughput of roughly graded material without unduly increasing the number of apertured, cylindrical drums. This is an important aspect of the present invention, as high numbers of apertured, cylindrical drums are relatively space consuming, which is typically not feasible on absorbent article manufacturing lines, where numerous different devices have to be accommodated. Also, unduly increasing the number of drums to enable a high mass throughput of roughly graded material requires complex systems to supply the roughly graded material to the apertured, cylindrical drums, as each drum has its own inlet.

Only a high mass throughput of roughly graded material allows manufacturing the fibrous structure in-line with the manufacture of the absorbent articles, in which they are applied. Today's manufacturing lines of absorbent articles run at very high speed (up to 500 m/min) and manufacture e.g. about 1000 diapers per minute. Thus, if the fibrous structure is to be made in-line with the absorbent article manufacture, the fibrous structure should be produced at a speed that allows unobstructed downstream transfer of the fibrous structure to the absorbent article or parts of the absorbent article (as further explained below). As the fibrous structure will typically have a length shorter than the overall length of the complete absorbent article, the manufacturing speed of the fibrous structure will not be identical to the manufacturing speed of the absorbent article, but the manufacturing speed of the fibrous structure will be slightly slower than the line speed of the absorbent article to allow unobstructed transfer of the fibrous structure to the absorbent article without changing the line speed of the absorbent article manufacture. Making the fibrous structure in-line with the absorbent article in which it is used is a desired option of the present invention.

In the process of the present invention, the roughly graded material is desirably introduced into the apertured, cylindrical drums at a total fiber throughput of from 70 kg/h to 420 kg/h, or from 100 kg/h to 400 kg/h; or from 160 to 330 kg/h. The foraminous carrier preferably moves at a manufacturing speed for the fibrous structure of 75 m/min to 350 m/min, or of 100 m/min to 350 m/min or of 150 m/min to 350 m/min. As explained above, the manufacturing speed of the fibrous structure will typically be slower than the overall line speed for the absorbent article manufacturing.

The system includes, within each of the apertured, cylindrical drums 10 one or more rotatable needle rolls 30 having an axis generally parallel to the axis of the apertured, cylindrical drum 10. Each needle roll 30 has a central shaft 35 and a plurality of needles 40 extending radially from the shaft 35 of the needle roll 30. The needle rolls 30 preferably rotate in a direction opposite that of its associated drum 10. Typically, each apertured, cylindrical drum 10 will have one needle roll 30. However, more than one needle roll can be used (not shown), e.g. two, three or even four needle rolls per drum. Having more than one needle roll per drum further helps to separate the fibers in the roughly graded material, which may in turn also lead to an increase the mass throughput of roughly graded material, which is desirable for the present invention for the reasons set out supra.

The needles 40 of the needle rolls 30 are adapted to rotationally agitate the roughly graded material within the drum 10. Such agitation is supplemental to that of the drum 10 itself. A primary function of the needle roll 30 is, in the course of their rotation, to disentangle individual fibers or fiber clusters comprising only few fibers (such that the fiber cluster will be able to pass through the apertures), from the roughly graded material, and flinging them outwardly through the apertures 20 out of the drums 10.

The needle roll can be moved within the drum to adjust the distance between the tips of the needles and the interior surface of the drum.

Additionally, the rotational speeds of the drum 10 and of the needle roll 30 are independently variable. This results in a high degree of flexibility in that the system can operate with a wide range of sizes and shapes of fibers and simultaneously achieve an optimum capacity or mass flow rate for the fibrous structure being formed.

In practice, it has been found that a desirable range of distances of the tips of the wire-like members from the interior surface of the drum lies in the range of 0.5 mm to 4 mm.

A pressure differential is provided (e.g. by applying a suction box or some other device know in the art underneath the foraminous carrier 50), typically coextensive with the apertured, cylindrical drums 10. The pressure differential causes a downwardly directed flow of air which serves to direct the flow of the air-borne stream of the fibers, after passing through the apertures 20, to be deposited upon the surface of the foraminous carrier 50.

A housing 70 at least partially surrounds the apertured, cylindrical drums 10 above the foraminous carrier 50. Typically all apertured, cylindrical drums 10 are at least partially surrounded by one common housing 70. The housing 70 is open at its lower end and preferably also at its upper ends. If the housing 70 is open at the upper ends, this helps to maintain the pressure differential and the airflow directed towards the foraminous carrier 50: Air is constantly sucked away below the foraminous carrier 50. To maintain the airflow, air must either be supplied through the apertured, cylindrical drums 10 or air can be provided from above the apertured, cylindrical drums 10. If air is provided through the apertured, cylindrical drums 10, the roughly graded material must be transported in a relatively large amount of air. However, it is believed that this may have an adverse effect on the overall mass throughput of roughly graded material. However, such adverse effect can at least partly be compensated by adjusting the dimension of the feeding tubes 60 accordingly. Thereby it is desirable to provide air from the environment of the apertured, cylindrical drums 10, for example through an upper opening in the housing 70.

In order to achieve maximum capacity, according to the invention, the rotational axes of the apertured, cylindrical drums 10 may extend in a direction transverse, for example at a right angle to the direction of movement of the foraminous carrier 50 underneath. Alternatively, the angle may slightly depart from a right angle, for example the rotational axes of the apertured, cylindrical drums 10 may extend at an angle of 85° to 105°, or at an angle of 90° to 95° to the direction of movement of the foraminous carrier 50.

The process of the present invention begins with a feeding device (not shown) which provides roughly graded material. It will be understood, for purposes of the invention, there may be only one feeding device, or there may be more than one feeding device as desired (e.g. in embodiments making use of more than one type of fibers, as described further below). As the fibers will typically be delivered to the feeding device in a very densely packed configuration (e.g. the raw material can be provided as bales), the feeding device needs to comprise a device that is able to "open" the bulk of fibrous material, i.e. to loosen the fibers of the bales and provide the roughly graded material. For example, the device can be a hammermill, defibrator, or other suitable device for "opening" the raw material, and delivering masses of roughly graded material to the system at a predetermined feed rate and predetermined mass flow rate of roughly graded material. The air-borne roughly graded material is then directed to the plurality of apertured, cylindrical drums through feeding tubes 60 of a suitable number and dimension.

Figure 2:
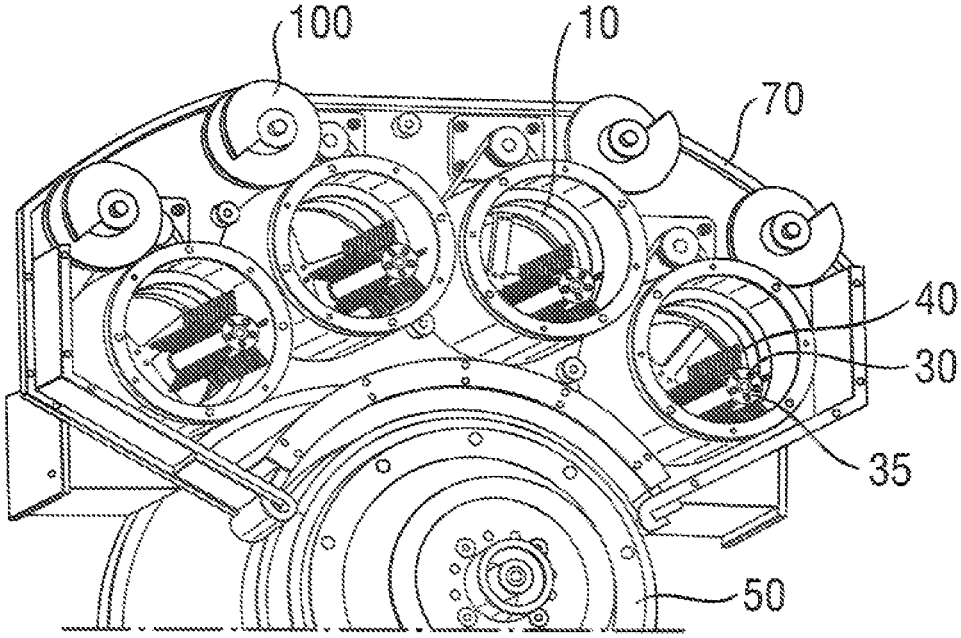
Figure 3:
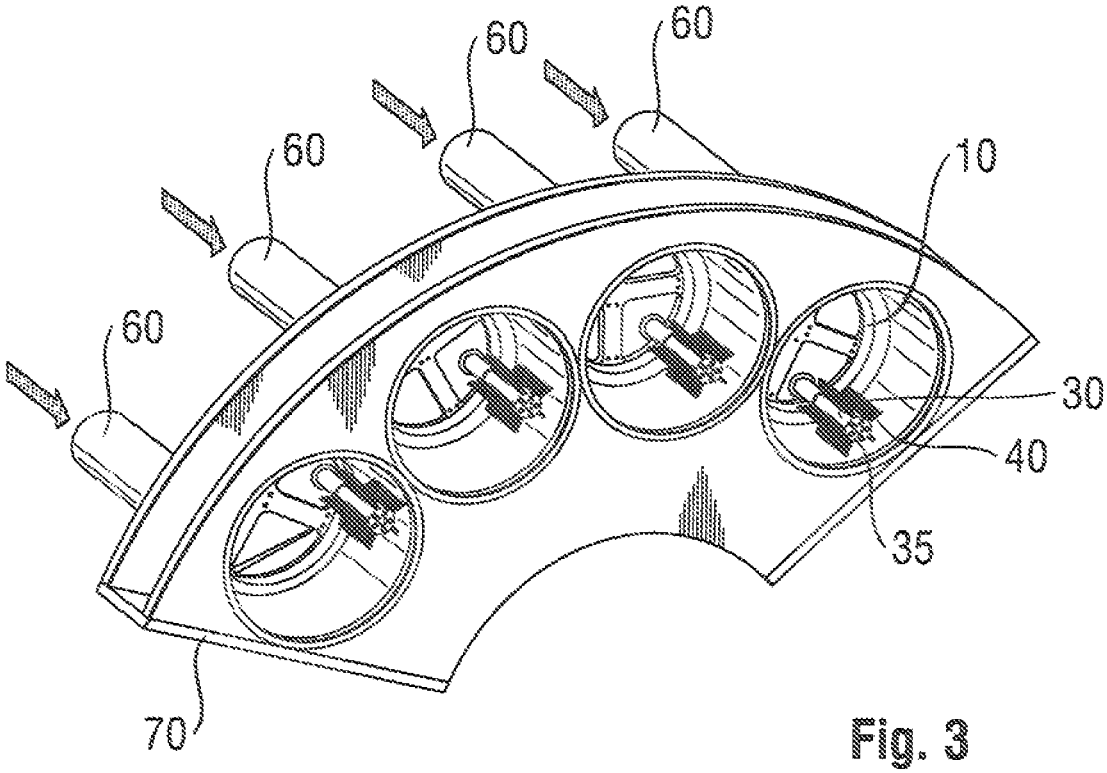
FIG. 3 is an enlarged view of the apertured, cylindrical drums shown in FIGS. 1 and 2.
Figure 4:
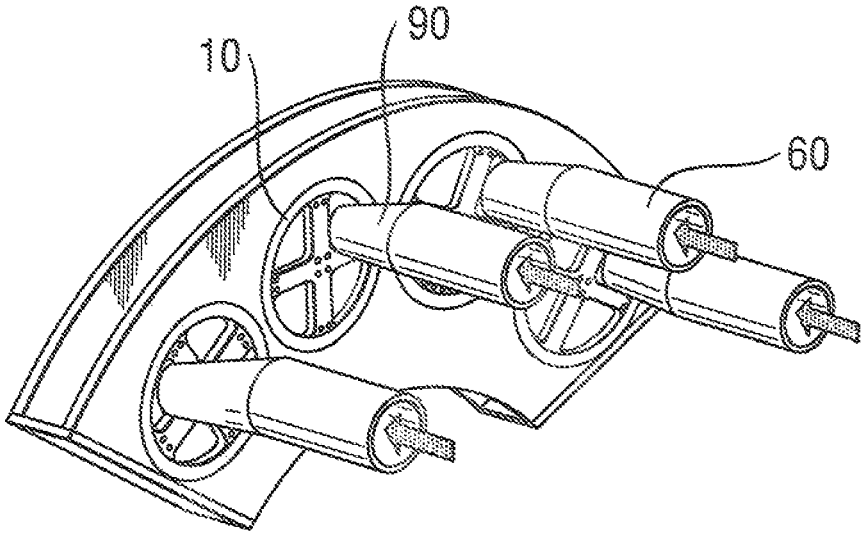
FIG. 4 is a representation of the feeding tubes providing the roughly graded material to the apertured, cylindrical drums.
Figure 5:
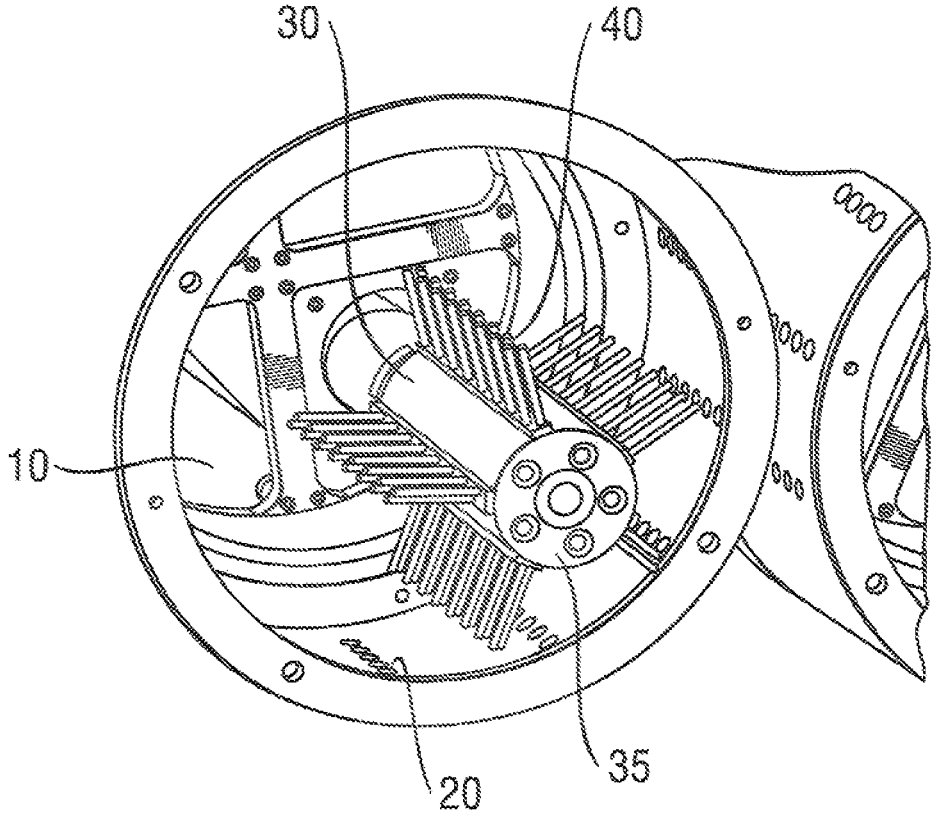
FIG. 5 is an enlarged view of one of the apertured, cylindrical drums shown in FIGS. 1, 2 and 4.

As explained above, the apertured, cylindrical drums 10 are positioned above, and extend substantially transversely of the direction of travel of the foraminous carrier 50 which is of any suitable design enabling fibers to be deposited on its upper surface, and then capable of delivering the fibrous structure thus formed to a subsequent station. In one embodiment the foraminous carrier 50 is configured as an endless belt. In another embodiment, the foraminous carrier 50 is configured in form of a drum. In the latter embodiments it is desirable that the drum-shaped foraminous carrier 50 has a diameter of from 400 mm to 800 mm, or from 500 mm to 600 mm. The drum 50 is placed such that the axis of the foraminous carrier drum 50 is positioned essentially horizontally. A drum-shaped foraminous carrier 50 is illustrated in FIGS. 1 and 2. In these embodiments, the pressure differential is applied for example by applying low-pressure or vacuum within the drum-shaped foraminous carrier. The fibers are deposited on the part of the outer surface of the foraminous carrier 50, which is directly adjacent the apertured, cylindrical drums 10. Due to the rotation of the drum-shaped foraminous carrier 50 the fibrous structure is moved downward while still held on the surface of the foraminous carrier 50 by the low-pressure or vacuum applied inside the drum-shaped foraminous carrier 50. Once the fibrous structure has reached a more downward position, it passes a zero pressure (i.e. no pressure differential between the inside and the outside of the drum) or overpressure zone (i.e. a higher pressure inside the drum compared to outside of the drum), which enables the fibrous structure to be transferred from the drum-shaped foraminous carrier 50 onto another carrier 80 which is located below the drum-shaped foraminous carrier 50, such as an endless belt. On this carrier 80 the fibrous structure will again be held by applying a pressure differential, for example with a suction box underneath.

In one embodiment, the fibrous structure is placed on top of another structure, such as a nonwoven web, a film or a multiplicity of webs and/or films. In these embodiments, the all layers will be held on the carrier due to an applied pressure differential. The fibrous structure can also be placed on top of a not yet finally assembled absorbent article. The term "not yet finally assembled" as used herein means that one or more layers or components (e.g. the fastening system or parts thereof; the topsheet, the backsheet, the absorbent core, the side panels or combinations thereof) of the absorbent article are still missing and will only be joined and/or attached to the absorbent article at a subsequent, downstream stage after the fibrous structure of the present invention has been placed on the not yet finally assembled absorbent article.

If the fibrous web forms part of a multi-layer acquisition system in an absorbent article, the fibrous web may be placed on top of the one or more other layers of the acquisition system, such as a nonwoven web. For example, if the fibrous structure is used as the lower layer of an acquisition system of an absorbent article, the fibrous structure is applied on top of the upper layer of the acquisition system. The thus assembled acquisition system will subsequently be delivered to and assembled with the remaining layers and components of the absorbent article.

In all these embodiments, the assembled layers and/or components will be held on the foraminous carrier 50 due to an applied pressure differential.

However, in another embodiment, the fibrous structure is formed directly on the surface of the foraminous carrier 50 with no additional layers underneath.

Importantly, in such a system, the fibrous structure does not need to be wound up on a roll for intermediate storage but is immediately further processed and incorporated into the final absorbent article. Therefore, it is not necessary to consolidate and reinforce the fibrous structure for storage (for example by having an additional bonding step by thermal bonding, pressure bonding, resin bonding, adhesive bonding, needle punching, hydroentangeling, or combinations thereof). Instead, the fibrous web, having relatively low integrity due to the absence of any consolidation step, can be directly introduced in the absorbent article.

The fibrous structure can be adhesively attached to the layer or layers onto which it is deposited. Adhesive attachment can be done by gluing the complete surface of the fibrous structure to the underlying layer or layers or by only gluing selected portions of the surface. Gluing can for example be done by applying the glue in a stripe, spiral, dot or any other pattern. However, it will be sufficient to use relatively low amounts of glue, since it should be avoided that the adhesive penetrates into the fibrous structure or the underlying layer or layers as such penetration will have an adverse effect on the absorption properties.

Also, the fibrous structure is preferably only cut transversely (i.e. in cross machine direction), once the fibrous structure has been placed on one or more other layers, either on the foraminous carrier 50 or at a later stage, e.g. on carrier 80. Thereby, the fibrous structure is stabilized to certain degree, reducing the risk of damaging the fragile fibrous structure upon cutting. As already set out supra, to enable in-line production of the fibrous structure with the manufacture of the absorbent article, in which it is used, it is desirable that the manufacture of the fibrous structure takes place at the same speed or about the same speed as the manufacture of the absorbent article as a whole. As modern absorbent article production lines often produce 1000 absorbent articles per minute or even more, this requires manufacturing speeds of the fibrous structure ranging from 200 to 350 m/min.

To enable fast and easy transfer of the fibrous structure to the absorbent article, the fibrous structure needs to have its final width already upon formation of the fibrous structure. This eliminates the need for any subsequent cutting steps along the longitudinal direction of the fibrous structure (i.e. in machine direction). Especially as the fibrous structure alone has low integrity due to the absence of any consolidation steps, cutting in the longitudinal direction bears the risk of damaging the fibrous structure. According to the present invention, the fibrous structure therefore does not undergo any longitudinal cutting (i.e. in the machine direction). The width of the fibrous structure of the present invention is from 4 cm to 25 cm, or from 5 cm to 15 cm, or from 5 cm to 12 cm.

Compared to traditional production lines for fibrous structures, which only need to accommodate the equipment for the manufacture of the fibrous structure, production lines of absorbent articles need to accommodate numerous other equipment required to manufacture or supply, and assemble all the different components of the absorbent article. Thus, absorbent article manufacturing lines have considerable higher space constraints compared to traditional production lines for fibrous structures. Therefore, it is advantageous to have a foraminous carrier 50 in form of a drum as such a carrier is less space consuming compared to a horizontal carrier.

Also in light of the space constrains it has been found that the plurality of apertured, cylindrical drums 10 can advantageously be arranged in an arc-shaped configuration. In an arc-shaped configuration, about 2 to 6, or 3 to 5 apertured, cylindrical drums 10 are arranged such that the drums in the middle are placed at a higher level compared to the apertured, cylindrical drums 10 placed on the sides of the arrangement. Due to the arc-shaped configuration, the apertured, cylindrical drums 10 can be arranged closer together compared to a linear, straight side by side arrangement. Arc-shaped configurations are illustrated in FIGS. 1 to 4.

The fibrous web can also be deposited on the foraminous carrier 50 in a shaped form, i.e. the longitudinal side edges of the fibrous structure do not form a straight line but take a certain shape, typically a curved shape. This can be facilitated e.g. by not having the complete surface of the carrier 50 being foraminous but by masking certain areas along the side edges of the carrier surface. Thereby, the fibers leaving the apertured, cylindrical drums 10 are only directed towards those areas of the carrier surface which is foraminous due to the low-pressure applied below the foraminous carrier 50.

Shaped fibrous structures may be desirable in absorbent articles to facilitate a narrow crotch portion of the absorbent article. Thus, if the fibrous structure is used in an acquisition system, as absorbent core or as part of an absorbent core, the part of the fibrous structure having a narrower width will be placed in the crotch region while the parts having a wider width are placed in the front and back waist region.

If the fibrous structure is shaped along its longitudinal side edges, the widest width of the fibrous structure should be less than 25 cm, less than 15 cm and the smallest width of the fibrous structure should be more than 4 cm, or more than 5 cm.

The apertured, cylindrical drums 10 each have inlets 90 for receiving the air-borne stream of roughly graded material which has been conveyed via the feeding tubes 60. Each one of the apertured, cylindrical drums 10 is adapted to receive a stream of the roughly graded material through its inlet 90. In one embodiment of the present invention, the inlets 90 of all apertured, cylindrical drums 10 are arranged on the same side of the apertured, cylindrical drums 10. Also, in one embodiment, the apertured, cylindrical drums are not interconnected with each other.

In one embodiment of the present invention, the apertured, cylindrical drums 10 do not have outlets. Thus, the roughly graded material can only leave the apertured, cylindrical drums 10 through the apertures 20.

The apertures 20 of the apertured, cylindrical drums 10 are of a predetermined shape, number and size, as specifically related to the types of fibers introduced to the system from the feeding devices. The number of apertured, cylindrical drums 10 may range from 2 drums to 6 drums. The preferred shape of the apertures 20 is either cylindrical or elongated holes. The diameter of cylindrical apertures 20 is preferably from 2 mm to 20 mm, more preferably from 5 mm to 15 mm. For elongate apertures 20 the length of the apertures is preferably from 20 to 50 mm. The open area formed by the apertures 20 of the apertured, cylindrical drum 10 is preferably from 30% to 60%, more preferably from 40% to 55% of the curved walls of the drum 10. A typical apertured, cylindrical drum 10 may have a diameter from 200 mm to 500 mm, more preferably from 250 mm to 350 mm.

In one embodiment, brushes 100 may be provided on the outer surface of each apertured, cylindrical drum 10. The brushes 100 can wipe off fibers which stick to the outer surface of the apertured, cylindrical drums 10, e.g. due to static friction. The brushes 100 may be configured such, that they are not in constant contact with the outer surface of the apertured, cylindrical drums 10 but can be brought into contact with the outer surface if needed while being somewhat remote from the outer surface for the remaining time.

After the fibrous structure is formed on the upper surface of the advancing foraminous carrier 50 (or outer surface in embodiments with a drum-shaped foraminous carrier 50), the fibrous structure may undergo further downstream operations. Such subsequent, downstream operations may entail, for example, bonding of the fiber structure with heat and/or pressure, adhesive bonding, resin bonding, by needle punching, hydroentangeling, or the like. However, as already set out supra, in a preferred embodiment of the present invention, the process does not include any bonding step such that the fibrous structure remains unconsolidated. Attaching the fibrous structure onto another layer as set out supra, is not considered to result in a bonded fibrous structure: The fibrous structure is not bonded (to itself) but rather, attaching the fibrous structure to another layer serves the purpose of immobilizing the fibrous structure relative to the other layer, for example to avoid shifting relative to the other layer or even falling off the other layer. It will still be possible to easily isolate individual fibers or clusters of fibers from the fibrous structure, as only a small part of fibers will be adhesively bonded to the other layer (mainly the fibers which are in direct contact with the other layer).

As the unbonded fibrous structure will have relatively low integrity, it is desirable to directly process the fibrous structure further, especially by incorporating it into an absorbent article in-line, i.e. without prior winding the fibrous structure on a roll before further processing. In a preferred embodiment, the fibrous structure is incorporated into an absorbent article by in-line subsequent, process steps as described supra.

Other subsequent operations may include laminating the fibrous structure with a separate film, scrim, or nonwoven material into a multiple layer structure.

Preferred fibres for use in the present invention are untreated cellulose fibers and/or modified cellulose fibers with a length between 2-5 mm or synthetic fibers with a length ranging from 10-45 mm; or of 20 mm to 40 mm; or of 25 mm to 40 mm. The synthetic fibers can be made of polyolefin, polyester or any other material.

In one embodiment, the fibrous structure may comprise modified cellulose fibers which have been chemically cross-linked. Such cross-linked cellulose fibers may have desirable absorbency properties for use in absorbent articles, especially for use as acquisition systems of absorbent articles. Exemplary chemically cross-linked cellulose fibers are disclosed in U.S. Pat. No. 5,137,537. In certain embodiments, the chemically cross-linked cellulose fibers are cross-linked with between 0.5 mole % and 10.0 mole % of a $C_2$ to $C_9$ polycarboxylic cross-linking agent or between 1.5 mole % and about 6.0 mole % of a $C_2$ to $C_9$ polycarboxylic cross-linking agent based on glucose unit. Citric acid and polyacrylic acid are exemplary cross-linking agents. According to certain embodiments, the cross-linked cellulose fibers may be crimped, twisted, or curled, or a combination thereof.

Further, according to one embodiment, the fibrous structure may comprise either the chemically cross-linked cellulose fibers or the chemically cross-linked cellulose fibers mixed with other fibers such as natural or synthetic polymeric fibers. According to exemplary embodiments, such other natural or synthetic polymeric fibers may include high surface area fibers, thermoplastic binding fibers, polyethylene fibers, polypropylene fibers, PET fibers, rayon fibers, lyocell fibers, and mixtures thereof.

It is desirable that the fibrous structure made according to the process of the present invention has a basis weight of at least 20 g/m$^2$; or at least 30 g/m$^2$ or at least 60 g/m$^2$. The basis weight should desirable be not more than 500 g/m$^2$, or no more than 350 g/m$^2$; or no more than 280 g/m$^2$; or no more than 250 g/m$^2$.

According to one embodiment of the invention, a stream of roughly graded material may comprise more than one type of fibers, wherein the fibers may differ e.g. with regard to fiber diameter, fiber length, chemistry (natural or synthetic fibers), straight, curled, crimped or twisted fibers; different degree of curl, crimp or twist; round trilobal, multilobal or otherwise shaped fibers; hollow or solid fibers. The different types of fibers may be applied in similar amounts (based on their weight) or may be applied in varying amounts, such that the fibrous structure comprises more fibers from a first type of fiber compared to a second type of fiber. If more than two types of fibers are use, each type of fiber may be present in the fibrous structure at the same amount (based on their weight) or may be present at different amounts (based on their weight).

The different types of fibers may be mixed (e.g. in a blender) prior to introducing them into the apertured, cylindrical drums. In such embodiments the obtained fibrous structure will have the different types of fibers distributed homogeneously throughout the fibrous structure.

Alternatively, and more desirable for the present invention, the different kinds of fibers may be supplied to different apertured, cylindrical drums through their respective inlets, such that different drums agitate different types of fibers. For such embodiments, the apertured, cylindrical drums should not be interconnected with each other in order to maintain the difference in fibers provided to the different apertured, cylindrical drums. Two or more drums may be supplied with a first type of fibers while one or more other drums are supplied with a second type of fibers. Further drums may be supplied with even further types of fibers. Also, one or more of the apertured, cylindrical drums may be supplied with a first mixture of different kinds of fibers, while one or more other apertured cylindrical drums are supplied with a different, second mixture of different kinds of fibers. Still alternatively, one or more of the apertured, cylindrical drums may be supplied with a first mixture of different kinds of fibers, while one or more other apertured cylindrical drums are supplied with a different, second mixture of different kinds of fibers and still additional apertured cylindrical drums are supplied with only one type of fibers. As will be obvious to the person skilled in the art, even more such variations will be possible. In any way, all these embodiments have in common that they lead to layered fibrous structures.

The different layers may have similar or varying basis weights. When used in absorbent articles, each layer may be tailor made to fulfill different tasks. For example one layer may mainly contribute to liquid distribution in the z-direction of the article, whereas another layer may mainly contribute to liquid distribution within the x-y plane of the absorbent article and a still further layer may serve storage of liquid.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;

d) providing a low-pressure below the foraminous carrier;

e) supplying the roughly graded material into the apertured, cylindrical drums through the inlet of each drum, wherein the roughly graded material is transported in an air-stream;

f) rotating the roughly graded material inside the apertured, cylindrical drums, whereby the roughly graded material is agitated within the drums by the needle rolls, thereby separating the fibers, and transporting the fibers through the apertures of the drums, wherein the roughly graded material is introduced into the rotatable, apertured, cylindrical drums at a total fiber throughput of from about 70 kg/h to about 420 kg/h; and g) drawing the fibers onto the foraminous carrier whereby the fibers are deposited to form a fibrous structure on the foraminous carrier, the fibrous structure having a width of from about 4 cm to about 25 cm.

2. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier, wherein the foraminous carrier moves at a speed of from about 750 m/min to about 450 m/min;

d) providing a low-pressure below the foraminous carrier;

e) supplying the roughly graded material into the apertured, cylindrical drums through the inlet of each drum, wherein the roughly graded material is transported in an air-stream;

f) rotating the roughly graded material inside the apertured, cylindrical drums, whereby the roughly graded material is agitated within the drums by the needle rolls, thereby separating the fibers, and transporting the fibers through the apertures of the drums; and g) drawing the fibers onto the foraminous carrier whereby the fibers are deposited to form a fibrous structure on the foraminous carrier, the fibrous structure having a width of from about 4 cm to about 25 cm.

3. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;

d) providing a low-pressure below the foraminous carrier;

e) supplying the roughly graded material into the apertured, cylindrical drums through the inlet of each drum, wherein the roughly graded material is transported in an air-stream, wherein the apertured, cylindrical drums have a diameter of from about 200 mm to about 500 mm;

f) rotating the roughly graded material inside the apertured, cylindrical drums, whereby the roughly graded material is agitated within the drums by the needle rolls, thereby separating the fibers, and transporting the fibers through the apertures of the drums; and g) drawing the fibers onto the foraminous carrier whereby the fibers are deposited to form a fibrous structure on the foraminous carrier, the fibrous structure having a width of from about 4 cm to about 25 cm.

4. The process of claim 3 wherein the apertured, cylindrical drums have a longitudinal dimension of from about 40 mm to about 250 mm.

5. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;

d) providing a low-pressure below the foraminous carrier;

e) supplying the roughly graded material into the apertured, cylindrical drums through the inlet of each drum, wherein the roughly graded material is transported in an air-stream;

f) rotating the roughly graded material inside the apertured, cylindrical drums, whereby the roughly graded material is agitated within the drums by the needle rolls, thereby separating the fibers, and transporting the fibers through the apertures of the drums; and g) drawing the fibers onto the foraminous carrier whereby the fibers are deposited to form a fibrous structure on the foraminous carrier, the fibrous structure having a width of from about 4 cm to about 25 cm, wherein the fibrous structure is made in-line with the manufacture of absorbent articles and the fibrous structure is introduced directly into the absorbent articles on the same manufacturing line.

6. The process of claim 5 wherein the fibrous structure is not cut along the longitudinal direction of the fibrous structure prior to introducing it into the absorbent articles.

7. The process of claim 1 wherein the needle rolls are counter rotating with the rotation of the apertured, cylindrical drums.

8. The process of claim 6 wherein the fibrous structure has a basis weight of from about 20 $g/m^2$ to about 500 $g/m^2$.

9. The process of claim 3 wherein the apertured, cylindrical drums are arranged in an arc-like configuration to form an arc-shaped drum assembly.

10. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;

d) providing a low-pressure below the foraminous carrier;

e) supplying the roughly graded material into the apertured, cylindrical drums through the inlet of each drum, wherein the roughly graded material is transported in an air-stream;

f) rotating the roughly graded material inside the apertured, cylindrical drums, whereby the roughly graded material is agitated within the drums by the needle rolls, thereby separating the fibers, and transporting the fibers through the apertures of the drums; and g) drawing the fibers onto the foraminous carrier whereby the fibers are deposited to form a fibrous structure on the foraminous carrier, the fibrous structure having a width of from about 4 cm to about 25 cm, wherein the foraminous carrier is in the form of a rotating foraminous drum and wherein the low-pressure is provided inside the foraminous drum, such that the fibers are drawn on the part of the foraminous drum which is directly adjacent the apertured, cylindrical drums.

11. The process of claim 10, wherein the foraminous carrier drum has a diameter of from about 400 mm to about 800 mm.

12. The process of claim 1 wherein the process does not include a step of bonding the fibrous structure.

13. The process of claim 1 wherein the fibers are deposited on the foraminous carrier such that the fibrous structure is shaped along its longitudinal side edges, wherein the widest width of the fibrous structure is less than about 25 cm and smallest width of the fibrous structure is more than about 4 cm.

14. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;

d) providing a low-pressure below the foraminous carrier;

e) supplying the roughly graded material into the apertured, cylindrical drums through the inlet of each drum, wherein the roughly graded material is transported in an air-stream;

f) rotating the roughly graded material inside the apertured, cylindrical drums, whereby the roughly graded material is agitated within the drums by the needle rolls, thereby separating the fibers, and transporting the fibers through the apertures of the drums; and g) drawing the fibers onto the foraminous carrier whereby the fibers are deposited to form a fibrous structure on the foraminous carrier, the fibrous structure having a width of from about 4 cm to about 25 cm, wherein the apertured, cylindrical drums do not have an outlet, such that the fibers can only leave the apertured, cylindrical drums through the apertures.

15. The process of claim 14 wherein the inlets of all apertured cylindrical drums are oriented on the same side of the drums.

16. A process for making a fibrous structure, the process comprising the steps of:

a) providing a fibrous material in the form of roughly graded material;

b) providing a plurality of apertured, cylindrical drums; each of the drums having an inlet and being rotatably mounted about a longitudinal axis, and wherein the inside of each drum comprises one or more rotatable needle rolls, each needle roll having a longitudinal axis arranged in parallel with the longitudinal axis of the corresponding apertured, cylindrical drum; and each needle roll having a shaft and a plurality of needles extending radially outwardly from the shaft, wherein the apertured cylindrical drums are not interconnected with each other;

c) providing a foraminous carrier underneath the plurality of apertured, cylindrical drums, wherein the apertured, cylindrical drums are positioned consecutively one after the other such that the longitudinal axis of each drum is transverse to the moving direction of the foraminous carrier;

d) providing a low-pressure below the foraminous carrier;

e) supplying the roughly graded material into the apertured, cylindrical drums through the inlet of each drum, wherein the roughly graded material is transported in an air-stream;

f) rotating the roughly graded material inside the apertured, cylindrical drums, whereby the roughly graded material is agitated within the drums by the needle rolls, thereby separating the fibers, and transporting the fibers through the apertures of the drums; and g) drawing the fibers onto the foraminous carrier whereby the fibers are deposited to form a fibrous structure on the foraminous carrier, the fibrous structure having a width of from about 4 cm to about 25 cm.

17. The process of claim 16, wherein at least two different kinds of fibers are introduced into the apertured, cylindrical drums such that a layered fibrous structure deposited on the foraminous carrier.

* * * * *